US010329810B2

(12) United States Patent
Kamata et al.

(10) Patent No.: US 10,329,810 B2
(45) Date of Patent: Jun. 25, 2019

(54) CHECK LINK APPARATUS

(71) Applicant: Mitsui Kinzoku Act Corporation, Yokohama-shi, Kanagawa (JP)

(72) Inventors: Kiyohiko Kamata, Yokohama (JP); Toshihisa Nishijyo, Yokohama (JP); Toku Fukaya, Yokohama (JP); Yoshiharu Settsu, Yokohama (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 665 days.

(21) Appl. No.: 13/940,057

(22) Filed: Jul. 11, 2013

(65) Prior Publication Data

US 2014/0041154 A1 Feb. 13, 2014

(30) Foreign Application Priority Data

Aug. 10, 2012 (JP) ..... 2012-178427

(51) Int. Cl.
*E05C 17/20* (2006.01)
*E05F 5/06* (2006.01)

(52) U.S. Cl.
CPC ..... *E05C 17/203* (2013.01); *E05C 17/20* (2013.01); *E05F 5/06* (2013.01); *E05C 17/206* (2013.01); *Y10T 16/61* (2015.01)

(58) Field of Classification Search
CPC ..... E05C 17/20; E05C 17/203; E05C 17/206; Y10T 16/61; Y10T 16/625; Y10T 16/628; Y10T 16/6285; Y10T 16/629; Y10T 16/6295
USPC ..... 16/82, 85, 86 R, 86 A, 86 B, 86 C
See application file for complete search history.

(56) References Cited

U.S. PATENT DOCUMENTS

| | | | | |
|---|---|---|---|---|
| 1,819,212 | A * | 8/1931 | Toncray | 16/82 |
| 2,193,990 | A * | 3/1940 | Travis | 16/86 C |
| 2,268,942 | A * | 1/1942 | Jacobs | 16/85 |
| 2,290,331 | A * | 7/1942 | Jacobs | 16/86 C |
| 2,507,389 | A * | 5/1950 | Travis et al. | 16/86 C |

(Continued)

FOREIGN PATENT DOCUMENTS

| | | |
|---|---|---|
| CN | 1754034 A | 3/2006 |
| CN | 1920233 A | 2/2007 |

(Continued)

OTHER PUBLICATIONS

Combined search and examination report issued in connection with Application No. GB1312076.1 dated Feb. 3, 2014.

(Continued)

*Primary Examiner* — Jeffrey O'Brien
(74) *Attorney, Agent, or Firm* — Foley & Lardner LLP

(57) ABSTRACT

A cheek link apparatus includes an arm in which a stopper portion is formed by covering a stopper core portion with a resin material and a holding member which defines a full open position of a door by being brought into abutment with the stopper portion. The stopper core portion has curved surfaces on end faces which face an abutment surface of the holding member at least when the abutment surface of the holding member is brought into abutment with the stopper portion. The stopper core position is positioned such that extensions extending in a direction in which a load is applied to the stopper core portion by the holding member pass the curved surfaces.

7 Claims, 9 Drawing Sheets

(56) References Cited

U.S. PATENT DOCUMENTS

| | | | | |
|---|---|---|---|---|
| 2,523,088 | A * | 9/1950 | Beyer | 16/86 C |
| 2,639,458 | A * | 5/1953 | Travis | 16/49 |
| 2,639,460 | A * | 5/1953 | Schonitzer | 16/86 C |
| 2,677,851 | A * | 5/1954 | Beyer | 16/86 R |
| 2,882,548 | A * | 4/1959 | Roethel | 16/86 R |
| 5,173,991 | A * | 12/1992 | Carswell | 16/86 A |
| 5,727,287 | A * | 3/1998 | Hosken et al. | 16/82 |
| 6,370,733 | B2 * | 4/2002 | Paton et al. | 16/86 C |
| 6,446,305 | B1 * | 9/2002 | Kneeland | 16/82 |
| 6,728,993 | B1 * | 5/2004 | Murayama | 16/342 |
| 6,813,811 | B2 * | 11/2004 | Matsuki et al. | 16/86 B |
| 6,842,943 | B2 * | 1/2005 | Hoffmann et al. | 16/82 |
| 7,143,473 | B2 * | 12/2006 | Matsuki | 16/86 C |
| 7,240,399 | B2 * | 7/2007 | Murayama et al. | 16/82 |
| 7,383,614 | B2 * | 6/2008 | Matsuki | 16/86 B |
| 7,469,944 | B2 * | 12/2008 | Kitayama et al. | 292/262 |
| 7,530,141 | B2 * | 5/2009 | Heinrichs et al. | 16/86 C |
| 7,552,953 | B2 * | 6/2009 | Schmoll et al. | 292/267 |
| 7,703,816 | B2 * | 4/2010 | Kitayama et al. | 292/262 |
| 7,861,372 | B2 * | 1/2011 | Tashima et al. | 16/86 C |
| 7,870,641 | B2 * | 1/2011 | Hoffmann et al. | 16/82 |
| 7,908,709 | B2 * | 3/2011 | Cruz et al. | 16/86 C |
| 7,913,354 | B2 * | 3/2011 | Tashima et al. | 16/86 C |
| 8,429,793 | B2 * | 4/2013 | Heinrichs et al. | 16/86 B |
| 8,499,416 | B2 * | 8/2013 | Settsu et al. | 16/86 C |
| 8,567,012 | B2 * | 10/2013 | Ng | 16/86 C |
| 2001/0016965 | A1 * | 8/2001 | Paton et al. | 16/85 |
| 2003/0051312 | A1 * | 3/2003 | Hoffmann et al. | 16/50 |
| 2003/0101537 | A1 * | 6/2003 | Matsuki et al. | 16/85 |
| 2003/0163895 | A1 * | 9/2003 | Liang et al. | 16/82 |
| 2004/0251696 | A1 * | 12/2004 | Murayama et al. | 292/262 |
| 2006/0150366 | A1 * | 7/2006 | Matsuki | 16/82 |
| 2006/0150367 | A1 * | 7/2006 | Matsuki | 16/86 C |
| 2006/0207058 | A1 * | 9/2006 | Heinrichs et al. | 16/86 B |
| 2006/0207059 | A1 * | 9/2006 | Van Den Heuvel | 16/86 B |
| 2008/0184525 | A1 * | 8/2008 | Cruz et al. | 16/85 |
| 2009/0070956 | A1 * | 3/2009 | Hoffmann et al. | 16/82 |
| 2009/0072552 | A1 * | 3/2009 | Kitayama et al. | 292/262 |
| 2009/0211056 | A1 * | 8/2009 | Tashima et al. | 16/85 |
| 2011/0016665 | A1 * | 1/2011 | Ng | 16/85 |
| 2012/0233813 | A1 * | 9/2012 | Settsu et al. | 16/82 |
| 2012/0246871 | A1 * | 10/2012 | Settsu et al. | 16/83 |

FOREIGN PATENT DOCUMENTS

| | | | |
|---|---|---|---|
| CN | 202108349 | U | 1/2012 |
| EP | 0 111 380 | | 6/1984 |
| JP | 3099226 | | 8/2000 |
| JP | 2003-118369 | A | 4/2003 |
| JP | 2010-116685 | A | 5/2010 |
| JP | 2010116685 | * | 5/2010 |
| JP | 2011-252282 | A | 12/2011 |
| JP | 2012-036573 | | 2/2012 |

OTHER PUBLICATIONS

Notification of First Office Action dated Jun. 25, 2015 issued in Chinese Application No. 201310347551.0, with English translation.

Office Action dated Jun. 17, 2015 which issued in Great Britain Application No. GB13132076.1.

Office Action for Japanese Patent Application No. 2012-178427 dated Apr. 26, 2016.

* cited by examiner

CHECK LINK APPARATUS

CROSS-REFERENCE TO RELATED APPLICATIONS

This application claims priority from Japanese Patent Application No. 2012-178427 filed on Aug. 10, 2012, the entire subject-matter of which is incorporated herein by reference.

BACKGROUND OF THE INVENTION

1. Field of the Invention

The present invention relates to a check link apparatus which defines a full open position of a door of a vehicle.

2. Description of the Related Art

A check link apparatus is used in a vehicle such as an automotive vehicle. This check link apparatus is disposed between a vehicle main body and a door and is configured to define a full open position (a maximum open position) of the door.

A general check link apparatus includes an arm, which is connected to a vehicle main body rotatably at one end thereof, and a holding member, which is mounted on a door and through which the arm is inserted slidably, and is configured to define a full open position of the door by bringing a stopper portion, which is provided at the other end of the arm, into abutment with an abutment surface of the holding member. Because of this, the stopper portion, which receives a load when the door is fully opened, is required to be strong.

For example, Japanese Patent No. 3099226 discloses a check link having a stopper portion, in which strength thereof is increased by forming a projecting portion by bending an expanded portion formed at an end portion of a metal core of an arm and by covering this projecting portion with a resin material.

In the case of the check link apparatus disclosed in Japanese Patent No. 3099226, since the check link apparatus includes the stopper portion having the projecting portion formed by bending the metal core, the strength of the metal core itself at the stopper portion is increased. However, the projecting portion and a corner portion of a plate end face of the metal core which forms the projecting portion are disposed ahead of a case of a holding member which travels along the arm to be brought into abutment therewith via the resin material. Because of this, when impact is applied to the resin material, which covers the stopper portion, as a result of the holding member coming into abutment with the stopper portion, there may be a situation in which the resin material is separated from the stopper portion, starting from the projecting portion of the metal core or the corner portion thereof. With a view to preventing the separation of the resin material from the stopper portion, a vertical dimension of the stopper portion needs to be increased so as not only to increase its load receiving area but also to decrease an angle difference when a vertical offset abutment occurs between the case and the stopper portion. This eventually enlarges the stopper portion. Moreover, in this check link apparatus, since the projecting portion is formed by bending the expanded portion formed by cutting a sheet material, there is also caused a problem that the workability is deteriorated, leading to high production costs.

SUMMARY

Illustrative aspects of the invention provide a check link apparatus which enables to configure a highly strong stopper portion at low costs.

According to one illustrative aspect of the invention, there is provided a check link apparatus comprising: an arm comprising a metal core that comprises: a plate-shaped arm core portion; a connecting core portion that is provided at a first end of the arm core portion and is connected rotatably to either of a vehicle main body or a door; and a stopper core portion that is provided at a second end, which is opposite to the first end, of the arm core portion and expands in a direction intersecting a longitudinal direction of the arm core portion, wherein a stopper portion is formed by covering at least the stopper core portion with a resin material; and a holding member that is mounted on the other of the vehicle main body and the door, through which the arm core portion is slidably inserted, wherein the holding member is configured to define a full open position of the door by being brought into abutment with the stopper portion, wherein the stopper core portion has a curved surface on an end face that is configured to face an abutment surface of the holding member at least when the abutment surface of the holding member is brought into abutment with the stopper portion.

According to the configuration described above, by providing the curved surface on the end face of the stopper core portion covered with the resin material which lies on the side with which the holding member is brought into abutment, when the load generated in association with the abutment between the holding member and the stopper portion is applied between the resin material and the curvilinear curved surface provided on the end face, the load can be dispersed by the curved surface, thereby making it possible to avoid a risk that the load is concentrically to a single point such as a corner portion. Therefore, a concentric application of the load to a specific location on the resin material can be prevented which would otherwise generate the separation of the resin material therefrom. Thus, the separation of the resin material from the stopper core portion can be prevented, thereby making it possible to form the highly strong stopper portion. Further, since the stopper portion is made up of the stopper core portion that is provided by expanding the other end of the arm core portion in the width direction, the stopper portion can be formed only by cutting, for example, a single sheet of steel into a metal core having a desired external shape, so that the workability becomes superior and the production costs can also be reduced. Moreover, the side of the stopper core portion which faces the holding member is formed by the curved surface made up of the thickness-direction face of the sheet of steel (e.g., the end face of the sheet of steel), and therefore, the strength of the stopper core portion is increased. This suppresses the deformation of the stopper core portion when the holding member is brought into abutment therewith, thereby making it possible to enhance the durability thereof. In this way, the stopper portion is configured such that the deformation of the stopper core portion is suppressed and that the load applied from the holding member is received by the curved surface, whereby the separation of the resin material can be prevented in a more ensured fashion.

According to another illustrative aspect of the invention, an extension extending along a direction in which a load is applied to the stopper core portion by the holding member is positioned where the extension passes the curved surface of the stopper core portion at least when the abutment surface of the holding member is brought into abutment with the stopper portion.

According thereto, when the abutment surface of the holding member is brought into abutment with the stopper portion, the load applied to the stopper portion can be dispersed by the curved surface of the stopper core portion in a more ensured fashion.

According to still another illustrative aspect of the invention, a hole portion is formed in the stopper core portion so as to penetrate the stopper core portion in a thickness direction thereof for receiving the resin material to be filled therein. The hole portion may be formed substantially in a center of the stopper core portion.

According thereto, at the stopper portion, the load from the holding member can be received not only by the curved surface but also by an inner circumferential surface of the hole portion, that is, the load receiving area of the stopper portion can be expanded by the hole portion. Moreover, the hole portion may be positioned substantially in the center of the stopper core portion. Consequently, the load applied to the resin material from the holding member can be further dispersed in a balanced manner. Furthermore, the coverings of the resin material formed on the upper and lower surfaces of the stopper core portion are connected to each other by the hole portion, so that the separation of the resin material can be suppressed in a more ensured fashion.

According to still another illustrative aspect of the invention, the arm portion is formed by the arm core portion being covered with the resin material, and at least one set of a recessed portion and a protuberant portion, on which a slider of the holding member is configured to slide, is formed by the covered resin material, and the stopper portion and the abutment surface of the holding member are brought into abutment with each other when the slider of the holding member is positioned on an upwardly inclined surface, which slopes up from the recessed portion to the protuberant portion, or on the protuberant portion.

According thereto, the holding member receives a force acting thereon in an opposite direction to the moving direction thereof by means of the sliding contact action between the slider and the upwardly inclined surface, whereby the load transmitted from the holding member to the stopper portion is suppressed. Therefore, the damage to the stopper portion and the generation of impact noise can be reduced, and it makes possible to prevent the separation of the resin material configuring the covering in a more ensured fashion.

According to still another illustrative aspect of the invention, a thickness of the resin material that covers the stopper core portion is made to become the thickest at a side of the stopper core portion configured to face the holding member.

According thereto, while avoiding the enlargement of the stopper portion, the thick resin material is allowed to be deformed to thereby act as a cushion to receive the load from the holding member when the stopper portion receives the load from the holding member. Thus, the separation of the resin material can be suppressed in a more ensured fashion.

According to still another illustrative aspect of the invention, the resin material that covers the stopper core portion has a first thickness lying between the end face of the stopper core portion which is configured to face the abutment surface and the side configured to face the holding member, the resin material that covers the stopper core portion has a second thickness lying between the curved surface and the side configured to face the holding member, and the second thickness is larger than the first thickness.

According to still another illustrative aspect of the invention, the resin material that covers the stopper core portion has a third thickness at portions other than the end face and the curved surface of the stopper core portion, and the first thickness is larger than the third thickness.

According to the invention, by providing the curved surface on the end face of the stopper core portion, which is covered with the resin material, on the side with which the holding member is brought into abutment, when the load generated in association with the abutment between the holding member and the stopper portion is applied between the resin material and the curvilinear curved surface provided on the end face, the load can be dispersed by the curved surface, thereby making it possible to suppress a situation where the load is concentrically to a single point such as a corner portion. Therefore, it is possible to avoid the concentric application of the load to the specific location on the resin material which would otherwise generate the separation of the resin material therefrom. Thus, the separation of the resin material from the stopper core portion can be prevented, thereby making it possible to form the highly strong stopper portion. Further, the stopper portion is made up of the stopper core portion that is provided by expanding the other end of the arm core portion in the width direction. For example, the stopper portion can be formed only by cutting the single sheet of steel into the metal core having the desired external shape. Therefore, according to the invention, the workability becomes superior and the production costs can also be reduced.

BRIEF DESCRIPTION OF THE DRAWINGS

FIG. 3 shows schematic plan views of a main part of a four-wheel vehicle which installs the check link apparatus, in which

FIG. 7 shows enlarged plan views of a stopper portion and a peripheral portion thereof of the arm, in which

DETAILED DESCRIPTION

Hereinafter, a check link apparatus according to the invention will be described in detail based on a preferred embodiment by reference to the accompanying drawings.

Figure 1:
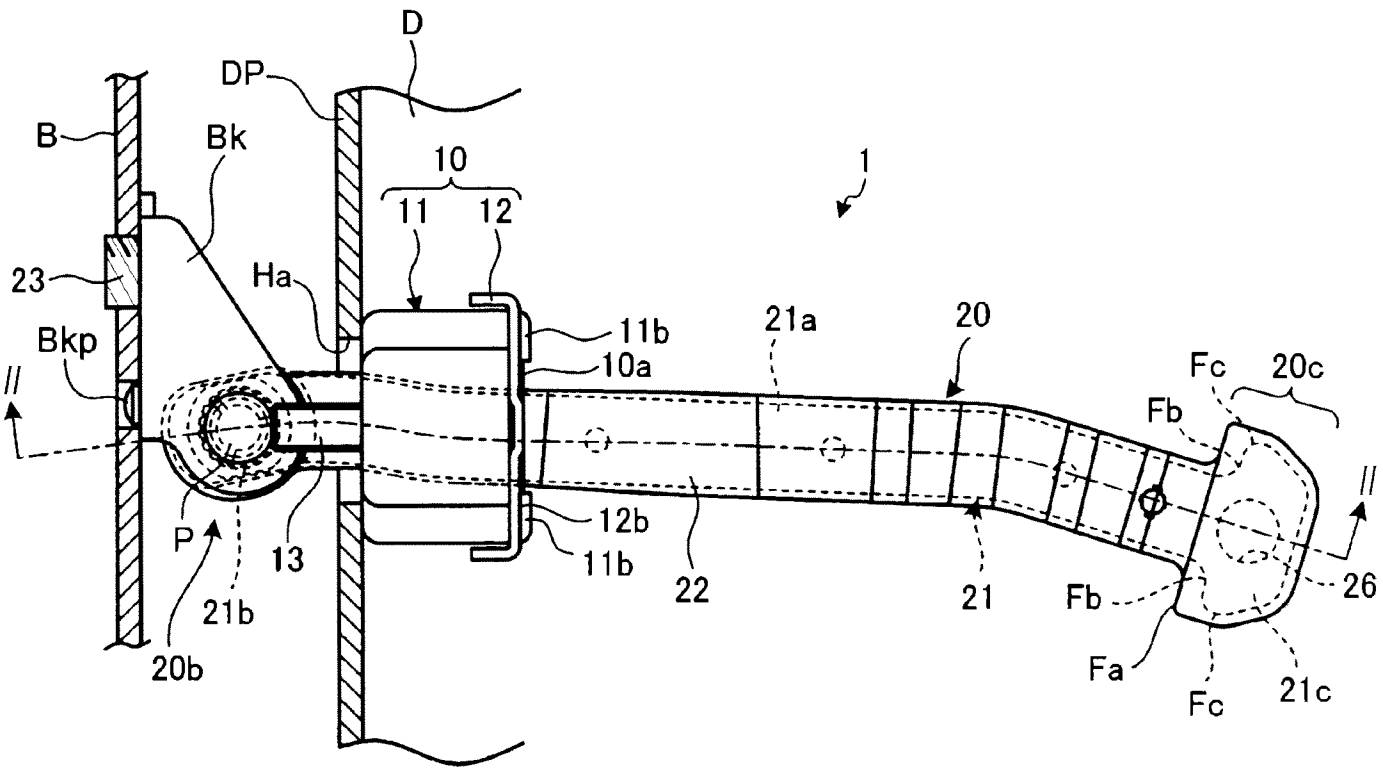
FIG. 1 is a plan view of a check link apparatus according to an embodiment of the invention.
Figure 2:
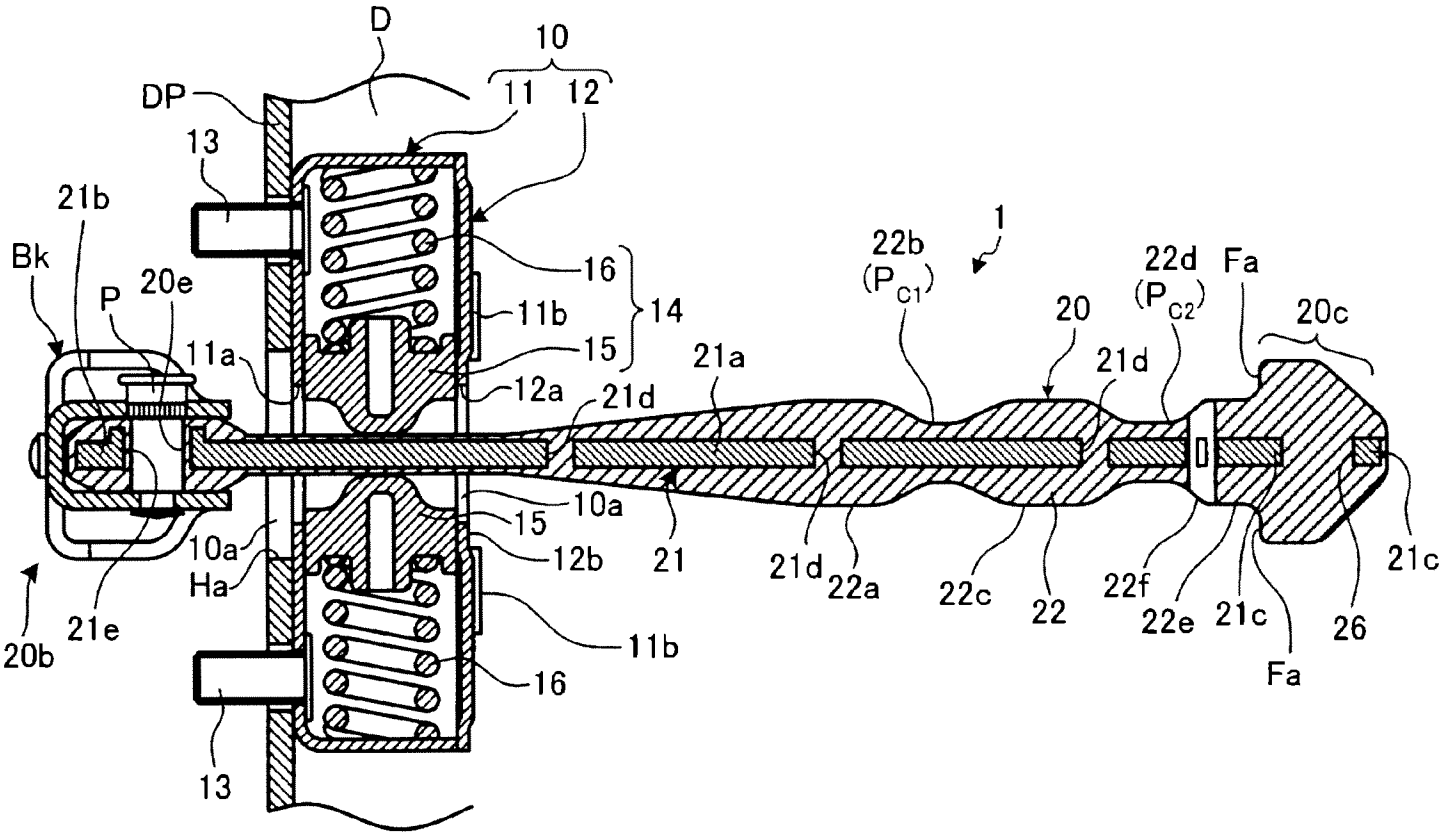
FIG. 2 is a sectional view taken along the line II-II in FIG. 1.

FIG. 1 is a plan view of a check link apparatus 1 according to an embodiment of the invention. FIG. 2 is a side sectional view of the check link apparatus 1 shown in FIG. 1 which is taken along the line II-II therein. FIG. 3 shows schematic plan views of a main part of a four-wheel vehicle which installs the check link apparatus 1, in which FIG. 3A is a plan view showing a state in which a door D is closed, and FIG. 3B is a plan view showing a state in which the door D is opened.

Figure 3A:
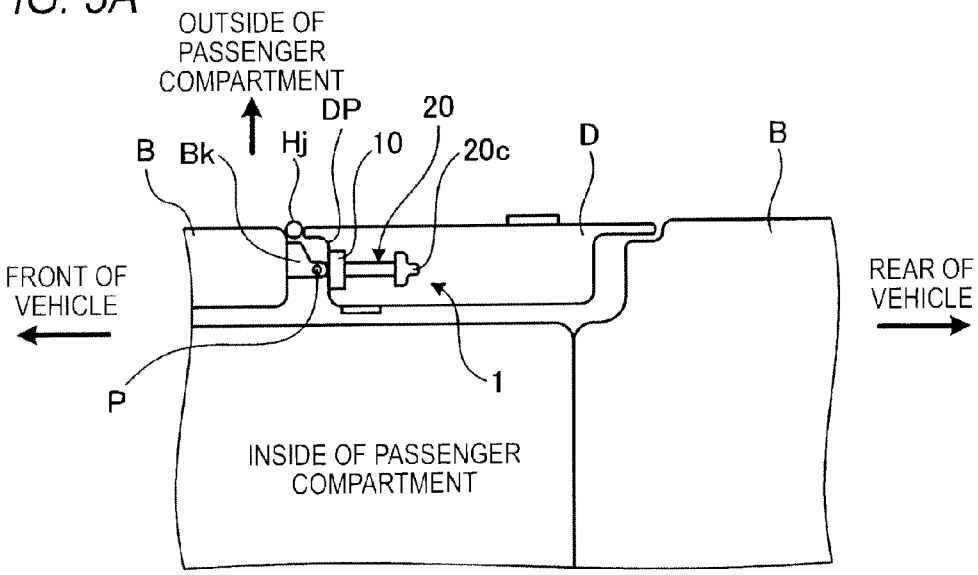
FIG. 3A is a plan view showing a state in which a door is closed.
Figure 3B:
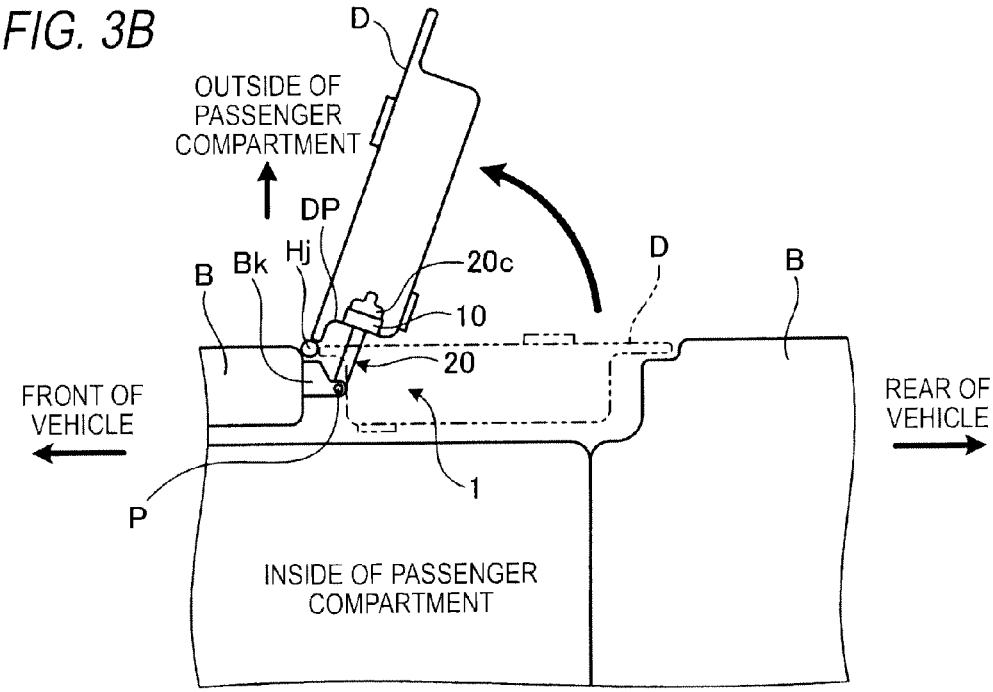
FIG. 3B is a plan view showing a state in which the door is opened.

As shown in FIGS. 1 to 3, the check link apparatus 1 includes a holding member 10 and an arm 20. The check link apparatus 1 is disposed between a vehicle main body (a vehicle body) B and a door D. In this embodiment, as the door D to which the check link apparatus 1 is applied, a front right-hand side door of the vehicle main body B is illustrated. The door D is rotatably supported on a door hinge Hj of the vehicle main body B at a front end portion thereof and is configured to be rotated about the door hinge Hj so as to be opened or closed between the closed state shown in FIG. 3A and the opened state shown in FIG. 3B.

As shown in FIGS. 1 and 2, the holding member 10 is fitted on the arm 20 so as to slide on the arm 20 along a longitudinal direction thereof (also, refer to FIG. 8) and is configured to define a full open position (a maximum open position) of the door D (refer to FIG. 3B) by being brought into abutment with a stopper portion 20*c*, which will be described later, provided at one end of the arm 20.

In the case of this embodiment, the holding member 10 has a case 11 and a cover plate 12 and holds a check mechanism 14 within a space defined by the case 11 and the cover plate 12. The case 11 and the cover plate 12 are made of a sheet of steel, for example. The cover plate 12 is locked and fixed to the case 11 by locking claws 11*b* which are formed on the case 11. The holding member 10 is fixed to a door panel DP by the case 11 being fixed to the door panel DP by two bolts 13 and nuts, not shown.

An opening 10*a* in the holding member 10, through which the arm 20 is inserted, is defined by openings 11*a*, 12*a* which are formed in centers of the case 11 and the cover plate 12, respectively. Incidentally, the case member 10 may have any other configurations than the above-described configuration which uses the case 11 and the cover plate 12 and may be formed into, for example, an integral box-like shape.

The check mechanism 14 has a pair of sliders 15, 15 configured to abut upper and lower surfaces of the arm 20 and a pair of coil springs 16, 16 configured to bias the corresponding sliders 15 towards the arm 20. The sliders 15 are formed of a synthetic resin having a small frictional coefficient relative to a covering 22 of the arm 20 such as polyacetal, for example. Incidentally, an elastic element such as a rubber may be used in place of the coil spring 16.

Figure 4:
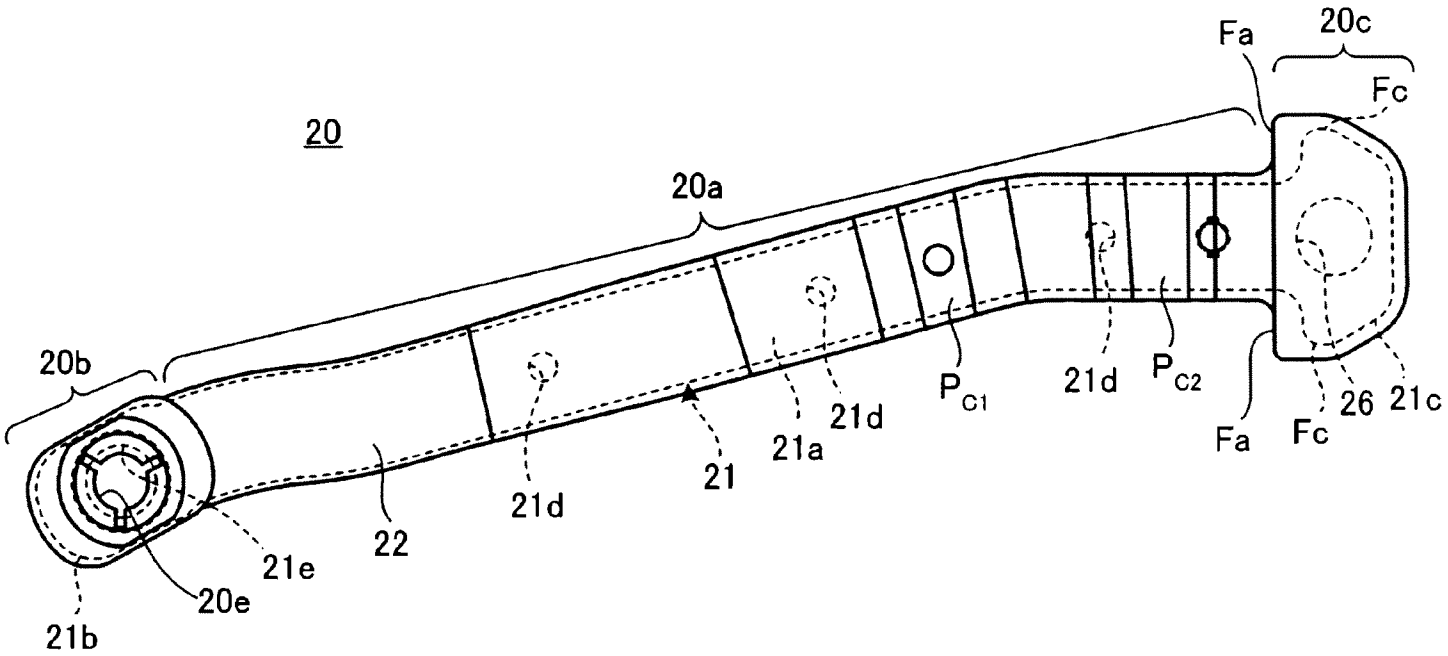
FIG. 4 is a plan view of an arm of the check link apparatus.
Figure 5:
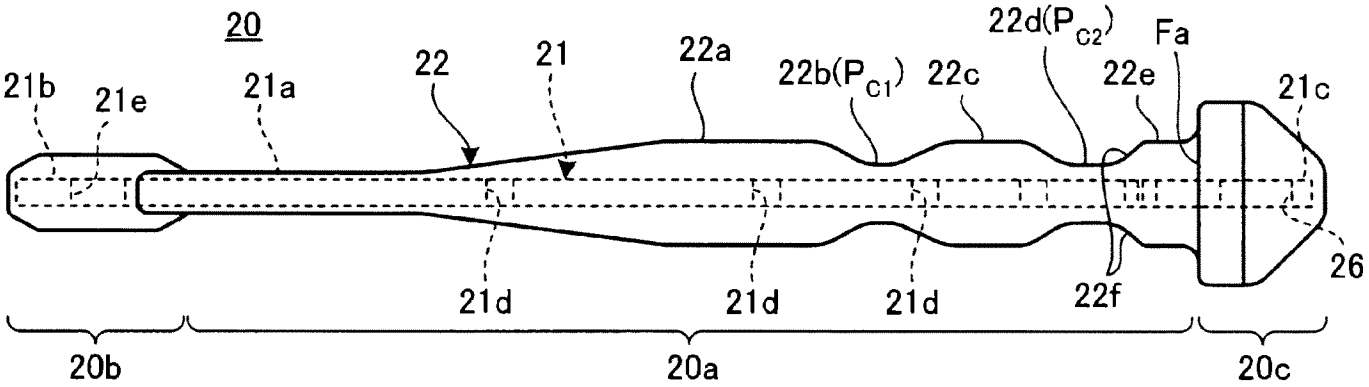
FIG. 5 is a side view of the arm shown in FIG. 4.
Figure 6:
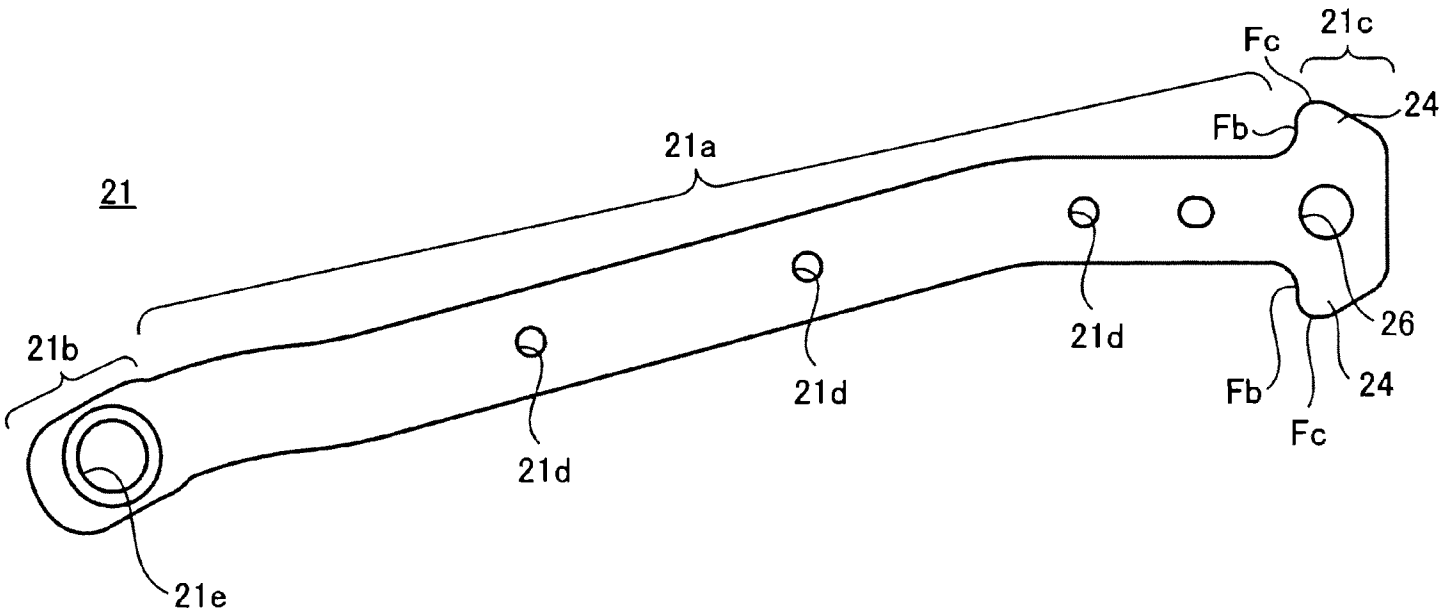
FIG. 6 is a plan view of a metal core which configures the arm.
Figure 7A:
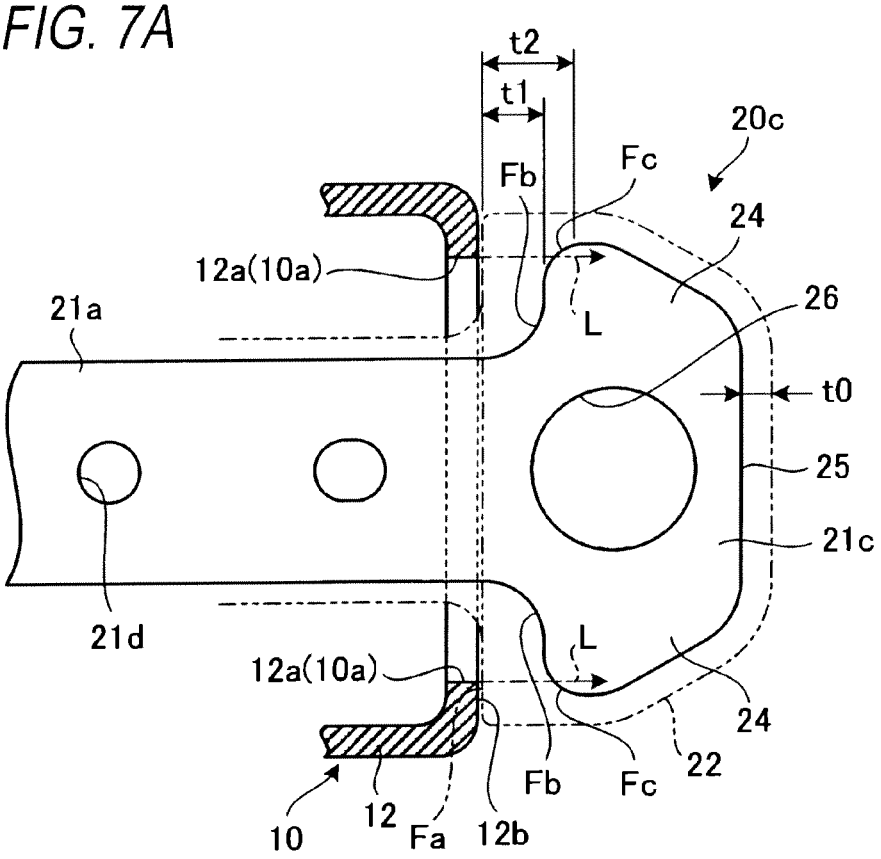
FIG. 7A is a plan view showing a state in which a holding member comes into straight abutment with the stopper portion.
Figure 7B:
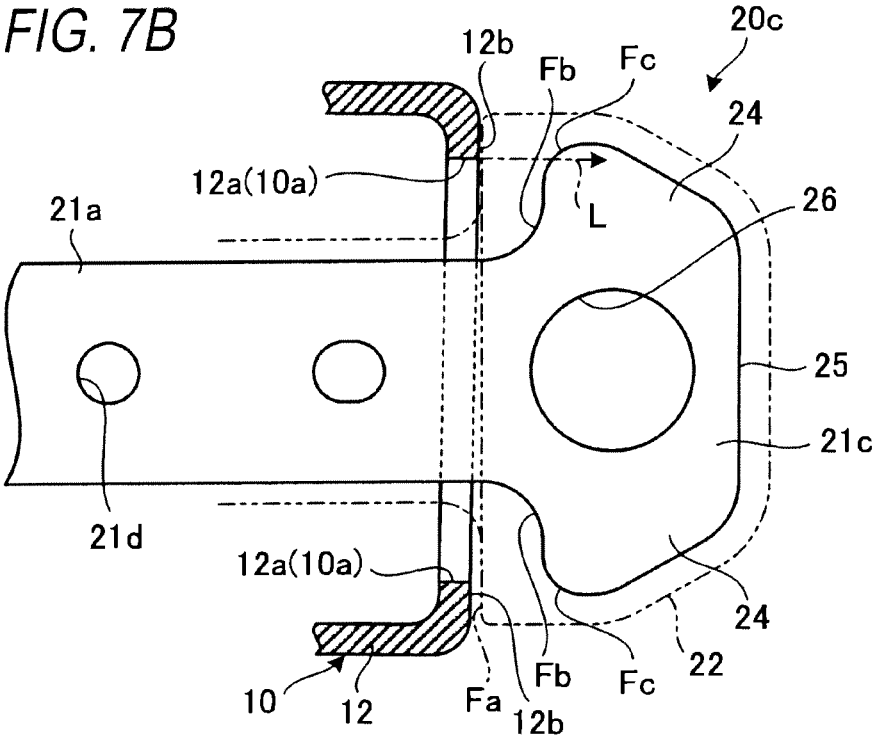
FIG. 7B is a plan view showing a state in which the holding member comes into offset abutment with the stopper portion.

FIG. 4 is a plan view of the arm 20 of the check link apparatus 1, FIG. 5 is a side view of the arm 20 shown in FIG. 4, and FIG. 6 is a plan view of a metal core 21 which configures the arm 20. Additionally, FIG. 7 shows enlarged plan views of the stopper portion 20*c* and a peripheral portion thereof of the arm 20, in which FIG. 7A is a plan view showing a state in which the holding member 10 comes into straight abutment with the stopper portion 20*c*, and FIG. 7B is a plan view showing a state in which the holding member 10 comes into offset abutment with the stopper portion 20*c*.

As shown in FIGS. 1, 2 and 4 to 7, the arm 20 is configured by the plate-shaped metal core 21 and the covering 22 that is of a synthetic resin and covers the metal core 21, and the arm 20 is a plate-shaped member extending along the longitudinal direction while being curved slightly in a planer view. The arm 20 includes an arm portion 20*a* that is long and has a plate-like shape, a connecting portion 20*b* that is formed at one end of the arm portion 20*a* and the stopper portion 20*c* that is formed at the other end of the arm portion 20*a*. It is preferable to use a synthetic resin which is easy to be worked and strong as a material for the covering 22, and it is hence preferable to use a thermoplastic resin such as polypropylene, nylon, ABS resin or polyacetal. Incidentally, in FIG. 7, in order to clarify the shape of the metal core 21, the covering 22 is indicated by a chain double-dashed line.

As shown in FIGS. 2 and 4, the connecting portion 20*b* has an opening portion 20*e* formed in the center portion thereof in such a way that an opening portion 21*e*, which will be described later, is covered with the covering 22. As shown in FIGS. 1, 2 and 7, a surface of the stopper portion 20*c* facing the arm portion 20*a* is made into a flat receiving surface Fa with which the holding member 10, that is, an abutment surface 12*b* of an outer surface of the cover plate 12 is brought into abutment.

As shown in FIGS. 1 and 2, in the arm 20, the connecting portion 20*b* provided at the one end of the arm portion 20*a* is connected to a bracket Bk, which is fixed to the vehicle main body B, with a swing pin or pivot P. And, the stopper portion 20*c* provided at the other end of the arm portion 20*a* is inserted through an arm insertion hole Ha formed in the door panel DP to be disposed within the door D via the holding member 10. The bracket Bk is fixed to the vehicle main body B with a bolt 23 while being positioned and prevented from rotation by a projecting portion Bkp.

As shown in FIGS. 2 and 5, in the arm 20, the covering 22 is molded over the metal core 21 so as to cover it such that the thickness of the synthetic resin configuring the covering 22 changes along the longitudinal direction. Although the thickness of the covering 22 is constant at an end portion of the arm portion 20*a* which lies to face the connecting portion 20*b*, the thickness increases towards a longitudinal center of the arm portion 20*a* and then decreases at a longitudinal intermediate portion (a first check portion $Pc_1$). Thereafter, the thickness increases again to become constant and decreases again near the stopper portion 20*c* (a second check portion $Pc_2$), increasing thereafter again. By changing the thickness of the covering 22 in this way, a first protuberant portion 22*a*, a first recessed portion 22*b* (the first check portion $Pc_1$), a second protuberant portion 22*c*, a second recessed portion (the second check portion $Pc_2$) and a third protuberant portion 22*e* are formed on the covering 22 from a substantially central portion continuously and sequentially in that order in a direction from the connecting portion 20*b* end towards the stopper portion 20*c* end.

As shown in FIGS. 2 and 4 to 6, the metal core 21 configuring the arm 20 is made up of a single plate. This single plate is formed substantially into a T shape and has an arm core portion 21*a* that is made of a sheet of steel and extends along the longitudinal direction while being curved slightly, a connecting core portion 21*b* that is formed at one end of the arm core portion 21*a*, and a stopper core portion 21*c* that is formed at the other end of the arm core portion 21*a* and expands in a width direction of the arm core portion 21*a*.

Resin holes 21*d* are formed in appropriate locations on the arm core portion 21*a*. The resin configuring the covering 22 enters the resin holes 21*d*, whereby the arm core portion 21*a* and the covering 22 are made difficult to be separated from each other. The opening portion 21*e* is formed in the connecting core portion 21*b* in a position which corresponds to the connecting hole 20*e* formed in the arm 20 at the one end thereof, and a diameter of the opening portion 21*e* is larger than (e.g., slightly larger than) a diameter of the connecting hole 20*e*.

Here, the configuration of the stopper portion 20*c* will be described more specifically by reference to FIGS. 4 to 8.

The stopper portion 20*c* is formed by covering the stopper core portion 21*c* of the core metal 21 with the covering 22, and the covering 22 is molded there into a tapered rectangular shape. An end face of the tapered rectangular covering 22 which lies on a side facing the arm portion 20*a* configures the receiving surface Fa against the holding member 10.

As shown in FIGS. 6, 7A and 7B, the stopper core portion 21*c* extends from the arm core portion 21*a* towards one end of the core metal 21 and has a pair of widthwise widened portions 24, 24 which are expanded in a direction (a width direction) intersecting the longitudinal direction of the arm core portion 21*a*. The stopper core portion 21*c* is formed into a trapezoidal shape which tapers towards one end thereof in a planar view. The stopper core portion 21*c* has substantially the same thickness as that of the arm core portion 21*a* (refer to FIGS. 2 and 5). End faces Fb, Fb, which are thickness surfaces defined by a thickness of the stopper core portion 21*c* of the core metal 21 (end faces of the sheet metal) corresponding to the receiving surface Fa of the covering 22, are provided at the widthwise widened portions 24, 24. Curved surfaces Fc, Fc are provided between the end faces Fb, Fb and external side portions (e.g, external side portions of the stopper core portion 21*c* where the widthwise widened portions 24, 24 have a maximum width). The curved surfaces Fc are curved so as to escape from an arm core portion 21*a* side towards a stopper core portion 21*c* side. Also, the curved surfaces Fc are provided on the end faces Fb which face the abutment surface 12*b* of the holding member 10 at least when the abutment surface 12*b* is brought into abutment with the stopper portion 20*c*. Therefore, the load from the holding member 10 is dispersed at the curved surfaces Fc.

As shown in FIG. 7A, extensions L are positioned such that each of which extends from a respective edge portion of the opening 10*a* (the opening 12*a*) of the holding member 10 in a direction in which the load is applied to the stopper core portion 21*c* from the holding member 10 and passes the curved surfaces Fc of the stopper core portion 21*c* in a state where the door D is fully opened and the holding member 10 is brought into abutment with the stopper portion 20*c*.

As shown in FIG. 7B, even in a state where the door D is fully opened and the holding member 10 is brought into offset abutment with the stopper portion 20*c*, the extension L is positioned so as to extend from the edge portion of the opening 10*a* (the opening 12*a*) of the holding member 10 in the direction in which the load is applied to the stopper core portion 21*c* from the holding member 10 and pass the curved surface Fc of the stopper core portion 21*c*. The offset abutment means a phenomenon in which the abutment surface 12*b* of the holding member 10 is brought into abutment with the receiving surface Fa of the stopper portion 20*c* in such a state that the abutment surface 12*b* and the receiving surface Fa are out of parallel due to deterioration with age of the check link apparatus as a result of frequent usage thereof.

A circular hole (a hole portion) 26 is formed substantially in the center of the stopper core portion 21*c* so as to penetrate the stopper core portion 21*c* in a thickness direction. The circular hole 26 is included in a widthwise dimension of the arm core portion 21*a* in a longitudinal direction of the arm core portion 21*a* and is formed in a position which lies between a distal end face 25 of the stopper core portion 21*c* and roots of the widthwise widened portions 24. In the circular hole 26 formed in this way, projections such as burrs are not left on upper and lower circumferential edge portions which configure boundaries with upper and lower surfaces of the stopper core portion 21*c*, and the circumferential edge portions are made to be flush with or are depressed slightly further downwards than the upper and lower surfaces of the stopper core portion 21*c* (refer to FIGS. 2 and 5). Accordingly, the stopper core portion 21*c* has superior workability.

As is apparent from FIG. 7A, the covering 22, which covers the stopper core portion 21*c* having the above-described configuration, is molded so that the thickness of the resin material differs between portions where the resin material covers the end faces Fb and the curved surfaces Fc and a substantially whole portion, which excludes the end faces Fb and the curved surfaces Fc. Namely, in the covering 22, assuming that the thickness of the resin material which covers the substantially whole portion, which excludes the end faces Fb and the curved surfaces Fc, is t0 (one example of a third thickness), the thickness of the resin material lying between the end faces Fb and the receiving surface Fa of the covering 22 becomes t1 (one example of a first thickness) that is of the order of twice t0. Further, the thickness of the resin material lying between the curved surfaces Fc and the receiving surface Fa becomes t2 (one example of a second thickness) that is larger than t1, because the curved surfaces Fc are curved towards the distal end at the portions where the resin material covers the curved surfaces Fc. Consequently, at the stopper portion 20*c*, the covering 22 is molded so that the thickness of the resin material (the covering 22) which covers the stopper core portion 21*c* becomes the thickest, which is t1 or t2, at the side which faces oppositely the holding member 10.

Figure 8:
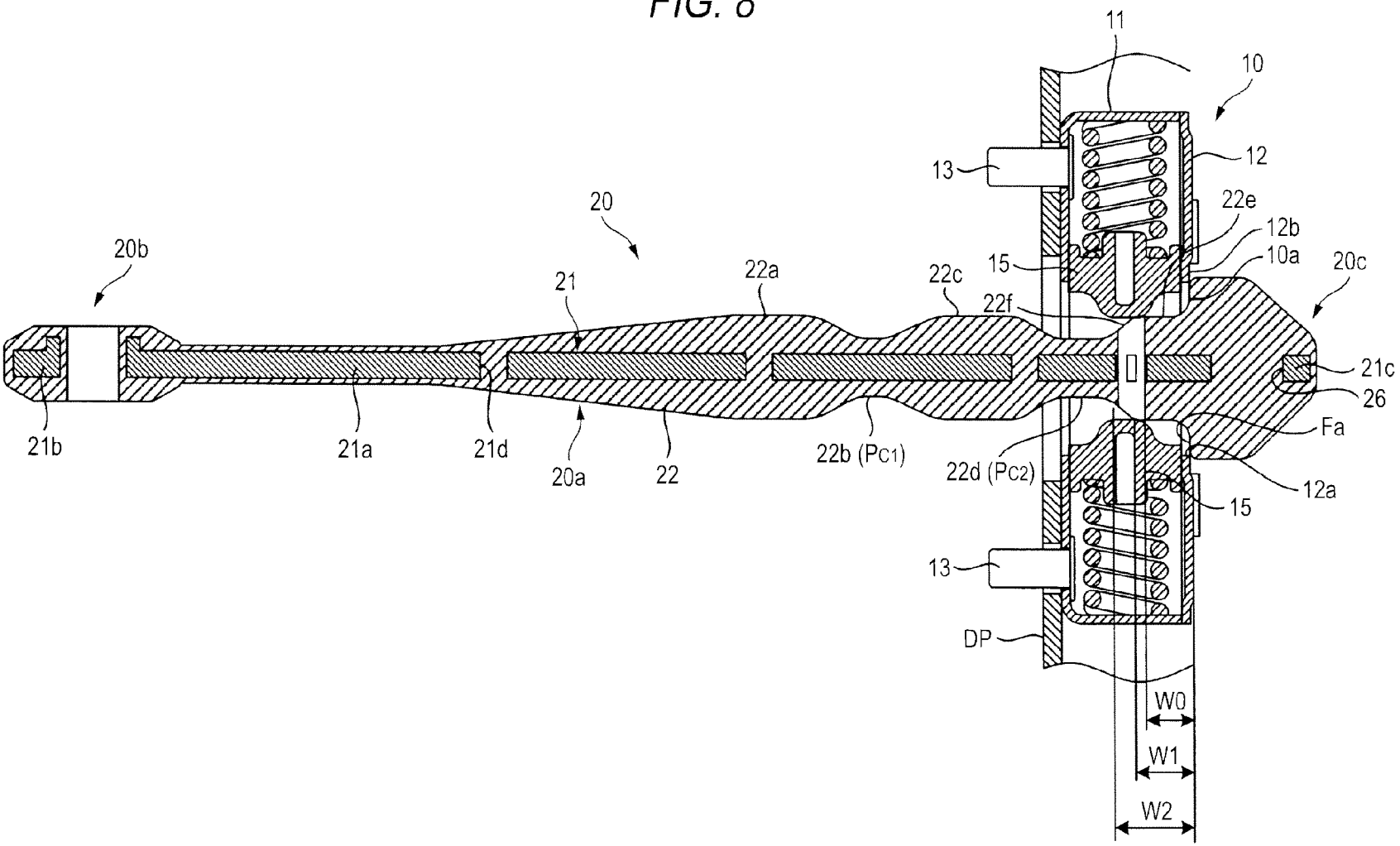
FIG. 8 is a side sectional view showing a state in which the door is in a full open position and the holding member is brought into abutment with the stopper portion.

FIG. 8 shows a side sectional view showing a state in which the door D is fully opened and the holding member 10 is brought into abutment with the stopper portion 20*c*.

In the check link apparatus 1, as shown in FIG. 8, when the door D is fully opened and the holding member 10 is brought into abutment with the stopper portion 20*c*, that is, when the abutment surface 12*b* of the cover plate 12 of the holding member 10 is brought into abutment with the receiving surface Fa of the stopper portion 20*a*, the sliders 15 of the holding member 10 are positioned on the third protuberant portion 22*e* which lies adjacent to the stopper portion 20*c*. Namely, in the direction in which the holding member 10 moves on the arm 20, a width W0 defined between the abutment surface 12*b* of the cover plate 12 and end portions of the sliding elements 15 which lie to face the cover plate 12 is set smaller than a width W1 defined between the receiving surface Fa of the stopper portion 20*c* and an end portion of the third protuberant portion 22*e* which lies to face the second recessed portion 22*d*. By setting the widths in this way, the sliders 15 ride over an upwardly inclined surface 22*f*, which slopes up from the second recessed portion 22*d* to the third protuberant portion 22*e*, immediately before the holding member 10 comes into abutment with the stopper portion 20*c*.

Incidentally, in a state where the door D is fully opened and the holding member 10 is brought to be in abutment with the stopper portion 20*c*, the sliders 15 of the holding member 10 may be configured so as to be positioned on the upwardly inclined surface 22*f* which slopes up from the second recessed portion 22*d* to the third protuberant portion 22*e*. As this occurs, the width W0 is set larger than the width W1 and smaller than a width W2 defined between the receiving surface Fa and an end portion of the upwardly inclined surface 22*f* which lies to face the second recessed portion 22*d*. Namely, the sliders 15 have come into sliding contact with the upwardly inclined surface 22*f* immediately before the holding member 10 comes into abutment with the stopper portion 20*c*.

Figure 9:
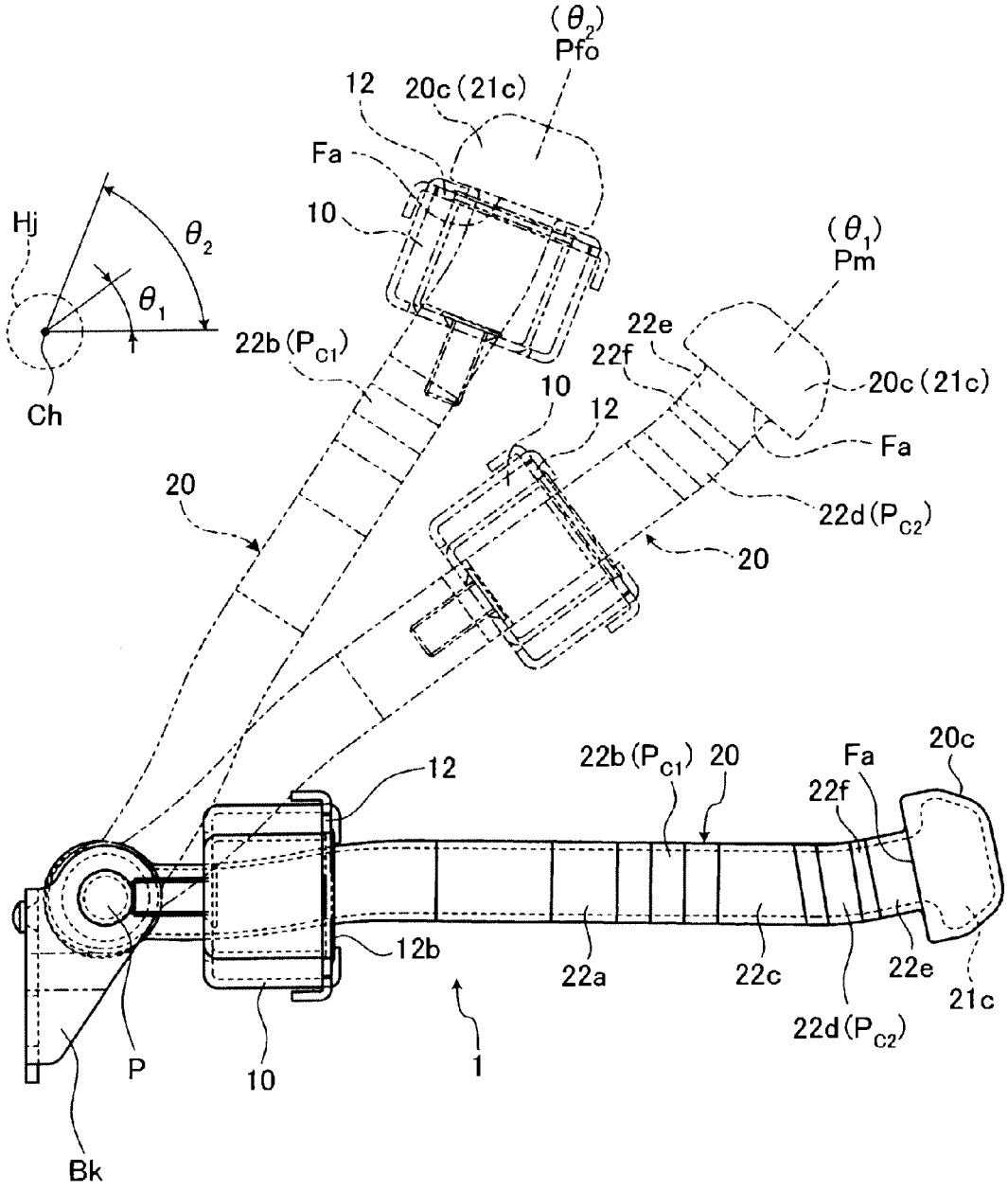
FIG. 9 is a plan view showing positions of the holding member in relation to the arm in the check link apparatus when the door is opened or closed.

FIG. 9 is a plan view showing positions of the holding member 10 in relation to the arm 20 in the check link apparatus 1 when the door D is opened or closed. Incidentally, in FIG. 9, reference character Ch denotes the center of the door hinge Hj of the vehicle main body B.

Firstly, as in the arm 20 indicated by solid lines in FIGS. 1 and 9, when the door D is closed into the vehicle main body B, the check link apparatus 1 is disposed so that the sliders 15 of the holding member 10 fixed to the door D are positioned nearest to the pivot P while the sliders 15 are in sliding contact with the upper and lower surfaces of the arm 20, that is, the holding member 10 is positioned farthest away from the stopper position 20*c*. In this state, the arm 20 is disposed so as to extend along a front-to-rear direction of the vehicle main body B.

Next, when the door D is opened from the vehicle main body B from the state indicated by the solid lines in FIG. 9, in the check link apparatus 1, the arm 20 rotates on an axis of the pivot P in a counterclockwise direction in FIG. 9 as the door D is opened. Then, the holding member 10 moves along the arm 20 towards the stopper portion 20*c* in association with the rotation of the arm 20. While the arm 20 and the holding member 10 are moving in the ways described above, the pair of sliders 15 move up and down to deform the pair of coil springs 16 elastically and appropriately in accordance with upper and lower surface configurations of the arm 20 while moving along the arm 20 in sliding contact with the upper and lower surfaces of the arm 20 by means of the spring force of the pair of coil springs 16.

As a result of the movement thereof along the arm 20, when the holding member 10 reaches the first check portion $Pc_1$ (the first recessed portion 22*b*), the pair of sliders 15 are restricted from moving from the first check portion $Pc_1$ by the spring force of the pair of coil springs 16 and by the shape of the recessed portion in the covering 22. As a result of this, the arm 20 is stopped rotating together with the door D in an intermediate open position Pin shown in FIG. 9 from the vehicle main body B. An opening angle of the door D with respect to the center Ch of the door hinge Hj then is denoted by reference character $\theta_1$ in FIG. 9.

When the door D is opened further from the state in which the door D is opened at the opening angle $\theta_1$, the holding member 10 passes the second check portion $Pc_2$ (the second recessed portion 22*d*) on the arm 20 and eventually reaches the third protuberant portion 22*e* while the force with which the door D is opened is absorbed by the sliding contact of the holding member 10 with the upwardly inclined surface 22*f*, whereby the cover plate 12 of the holding member 10 comes into abutment with the stopper portion 20*c* of the arm 20. As a result, the arm 20 is stopped rotating together with the door D in a full open position Pfo shown in FIG. 9 which lies farther away from the vehicle main body B than the intermediate open position Pm. In this state, the pair of sliders 15 are positioned on the third protuberant portion 22*e* by the spring force of the pair of coil springs 16 or the pair of sliders 15 are returned to the second check portion $Pc_2$ (the second recessed portion 22*d*) due to the reaction generated when the holding member 10 comes into abutment with the stopper portion 20*c*, whereby the holding member 10 is restricted from moving further in the longitudinal direction of the arm 20. As a result, the arm 20 is stopped rotating together with the door D in the full open position Pfo shown in FIG. 9 which lies farther away from the vehicle main body B than the intermediate open position Pm. An opening angle of the door D with respect to the center Ch of the door hinge Hj then is denoted by reference character $\theta_2$ in FIG. 9.

The cover plate 12 of the holding member 10 is in abutment with the stopper portion 20*c* of the arm 20 in the full open position Pfo, and therefore, the check link apparatus 1 is able to not only prevent the opening of the door D farther away from the vehicle main body B but also hold the door D in the full open position Pfo relative to the vehicle main body B.

On the other hand, when the door D is closed from the above-described full open position Pfo, the holding member 10 fixed to the door D moves along the arm 20 towards the bracket Bk while rotating the arm 20 on the axis of the pivot P via the pair of sliders 15. While the holding member 10 and the arm 20 are moving in the ways described above, the pair of sliders 15 move up and down to deform the pair of coil springs 16 elastically and appropriately in accordance with upper and lower surface configurations of the arm 20 while moving along the arm 20 in sliding contact with the upper and lower surfaces of the arm 20 by means of the spring force of the pair of coil springs 16. As a result of the movement thereof along the arm 20, moving in an opposite way to the way in which the holding member 10 moves when the door D is opened, the holding member 10 moves from the second check portion $Pc_2$ to the position where the holding member 10 lies closest to the pivot P by way of the first check portion $Pc_1$.

Thus, as has been described heretofore, in the check link apparatus 1 according to this embodiment, the stopper core portion 21*c* has the curved surfaces Fc at the end faces Fb that face oppositely the abutment surface 12*b* of the holding member 10 at least when the abutment surface 12*b* of the holding member 10 comes into abutment with the stopper portion 20*c*.

In this way, by providing the curved surfaces Fc at the end faces Fb on the side of the stopper core portion 21*c* covered with the covering 22 with which the holding member 10 comes into abutment, even in the event that the holding member 10 comes into straight abutment with the stopper portion 20*c* (refer to FIG. 7A) or even in the event that the holding member 10 comes into offset abutment with the stopper portion 20*c* (refer to FIG. 7B), the load generated as a result of either of the abutments can be dispersed by the curved surfaces Fc when the load is applied between the resin material configuring the covering 22 and the curvilinear curved surfaces Fc provided at the end faces Fb, so that it makes possible to avoid the occurrence of a risk that the load is concentrated on a single point such as a corner portion. Therefore, it is possible to avoid an application of the concentrated load to the resin material which causes a crack in the resin material. Accordingly, it makes possible to prevent the separation of the covering 22 from the stopper core portion 21*c* to thereby configure the highly strong stopper portion 20*c*.

In addition, the embodiment adopts the configuration in which the extensions L extending in the direction in which the load is applied to the stopper core portion 21*c* by the holding member 10 are positioned so as to pass the curved surfaces Fc of the stopper core portion 21*c* at least when the abutment surface 12*b* of the holding member 10 comes into abutment with the stopper portion 20*c*. According thereto, the load applied to the stopper portion 20*c* when the abutment surface 12*b* of the holding member 10 comes into abutment with the stopper portion 20*c* can be dispersed by the curved surfaces Fc of the stopper core portion 21*c* in an ensured fashion.

The stopper portion 20*c* is made up of the stopper core portion 21*c* which is provided by expanding the other end of the arm core portion 21*a* in the width direction. Therefore, the stopper portion 20*c* can be formed only by cutting, for example, a single sheet of steel into the metal core 21 having the external shape shown in FIG. 6. Thus, the superior workability is realized, and the production costs can also be reduced. Moreover, the portions of the stopper core portion 21*c* corresponding to the receiving surface Fa, that is, the portions of the stopper core portion 21*c* which lie to face the holding member 10 are formed into the end faces Fb (the curved surfaces Fc) that are made up of the thickness-ways surfaces of the sheet of steel (the end faces of the sheet of steel), and the circular hole 26 is not positioned in the widthwise widened portions 24. Therefore, the stopper core portion 21*c* becomes highly strong, and hence, the stopper core portion 21*c* can be restrained from being deformed when the holding member 10 is brought into abutment with the stopper portion 20*c*, thereby making it possible to enhance the durability of the stopper core portion 21*c*. In this way, at the stopper portion 20*c*, the stopper core portion 21*c* is configured such that the deformation thereof is suppressed and the load from the holding member 10 is received by the curved surfaces Fc, thereby making it possible to prevent the separation of the resin material configuring the covering 22 in a more ensured fashion.

The circular hole 26 is formed in the stopper portion 20*c* so as to penetrate through the stopper core portion 21*c* so that the resin material configuring the covering 22 is filled therein. Therefore, in the stopper portion 20*c*, the load from the holding member 10 can be received not only by the end faces Fb and the curved surfaces Fc but also by the inner circumferential surface of the circular hole 26. Namely, the load receiving area of the stopper portion 20*c* is increased by the circular hole 26. The circular hole 26 is positioned substantially in the center of the stopper core portion 21*c*, for example. Consequently, the load applied from the holding member 10 to the resin material configuring the covering 22 can be dispersed in a better balanced fashion. Further, the coverings 22 of the resin material formed on the upper and lower surfaces of the stopper core portion 21*c* can be connected to each other by the circular hole 26, and therefore, the separation of the resin material can be suppressed in a more ensured fashion. Incidentally, there may be configured such that a plurality of circular holes 26 is provided. In this case, for example, the plurality of circular holes 26 may be arranged so as to be symmetry with respect to a center line passing substantially central parts in width direction of the metal core 21 and extending along a longitudinal direction of the metal core 21. The plurality of circular holes 26 may also be provided in the stopper core portion so as to be symmetry with respect to the center line.

In other words, in the stopper portion 20*c*, the load applied from the holding member 10 to the resin material configuring the covering 22 is received by the curved surfaces Fc of the stopper core portion 21*c* to thereby be dispersed therefrom and is also received by the circular hole 26 to thereby be dispersed therefrom. Therefore, the large load receiving area can be ensured, and the load generated in this load receiving surface can be dispersed effectively. According thereto, the separation of the covering 22 can be prevented while receiving the holding member 10 in an ensured fashion, thereby making it possible to enhance the strength and durability of the stopper portion 20*c* further. Moreover, projections such as burrs are not left on the circumferential edge portions of the circular hole 26, and the circumferential edge portions are made to be flush with or are depressed slightly further downwards than the upper and lower surfaces of the stopper core portion 21*c*. In this way, in the event that no projections are left on the circumferential edge portions of the circular hole 26, a large hole can be ensured within a range which is included in the widthwise dimension of the arm core portion 21*a*, and therefore, the circular hole 26 is not positioned in the widthwise widened portions 24. Thus, the load receiving area can be expanded while making the stopper core portion 21*c* highly strong. In addition, the load from the upper and lower portions of the opening 10*a* in the holding member 10 are applied uniformly to the upper and lower surfaces of the resin materials which lie above and below the circular hole 26, and therefore, the applied load can be received in a well balanced fashion.

In the check link apparatus 1, the arm portion 20*a* is formed by covering the arm core portion 21*a* with the resin material, and at least one set of a recessed portion and a protuberant portion on which the sliders 15 of the holding member 10 slide is formed on the arm portion 20*a* by the covering 22 (in this embodiment, in total two and half sets of recessed portions and protuberant portions including the set of the first protuberant portion 22*a* and the first recessed portion 22*b*, the set of the second protuberant portion 22*c* and the second recessed portion 22*d*, and the third protuberant portion 22*e*). In this configuration, the abutment surface 12*b* of the holding member 10 is brought into abutment with the stopper portion 20*c* when the sliders 15 of the holding member 10 are positioned on the upwardly inclined surface 22*f* which slopes up from the second recessed portion 22*d* to the third protuberant portion 22*e* or on the third protuberant portion 22*e* (refer to FIG. 8). By adopting this configuration, the holding member 10 receives a force acting thereon in an opposite direction to the moving direction thereof by means of the sliding contact action between the sliders 15 and the upwardly inclined surface 22*f*. According thereto, the load transmitted from the holding member 10 to the stopper portion 20*c* is suppressed, and the damage to the stopper portion 20*c* and the generation of impact noise can be reduced, thereby making it possible to prevent the separation of the resin material configuring the covering 22 in a more ensured fashion.

In the check link apparatus 1, the thickness of the resin material that covers the stopper core portion 21*c* is formed so that the thickness of the resin material at the end facing the holding member 10 becomes t1 or t2 which is the thickest (refer to FIG. 7A). Therefore, while avoiding the enlargement of the stopper portion 20*c*, the resin material configuring the covering 22 is allowed to be deformed to thereby act as a cushion to receive the load from the holding member 10 when the stopper portion 20*c* receives the load from the holding member 10. Thus, the separation of the resin material can be suppressed in a more ensured fashion.

The invention is not limited to the embodiment that has been described heretofore and can, of course, be modified freely without departing from the spirit and scope of the invention.

For example, in the above-described embodiment, the holding member 10 is mounted on the door D and the connecting portion 20*b* is supported rotatably on the bracket Bk provided on the vehicle main body B. Alternatively, a configuration may be adopted in which the holding member 10 is provided on the vehicle main body B, while the connecting portion 20*b* is supported rotatably on the door D.

In addition, in the above-described embodiment, while the check link apparatus 1 is illustrated in which the widthwise widened portions 24 which configure the stopper core portion 21*c* are disposed in the width direction, the orientation of the arm 20 may be changed as required depending upon models on which the check link apparatus 1 is installed, and the widthwise widened portions 24 may, of course, be used in a vertical direction or in an inclined posture.

What is claimed is:

1. A check link apparatus comprising:

an arm comprising a metal core that comprises:

a plate-shaped arm core portion;

a connecting core portion that is provided at a first end of the arm core portion and is connected rotatably to either of a vehicle main body or a door; and a plate shaped stopper core portion that is provided at a second end, which is opposite to the first end, of the arm core portion and expands in a direction intersecting a longitudinal direction of the arm core portion, wherein the stopper core portion is coplanar with the arm core portion, the stopper core portion has a substantially uniform thickness, and a stopper portion is formed by covering at least the stopper core portion with a resin material; and a holding member that is mounted on the other of the vehicle main body and the door, through which the arm core portion is slidably inserted, wherein the holding member is configured to define a full open position of the door by being brought into abutment with the stopper portion, wherein the stopper core portion has a curved surface on an end face that is configured to face an abutment surface of the holding member at least when the abutment surface of the holding member is brought into abutment with the stopper portion, the end face continued from the arm core portion curves toward a plane orthogonal to a longitudinal axis of the arm at the stopper core portion so as to form at least a portion extending along the plane orthogonal to the longitudinal axis of the arm at the stopper core portion, and the portion of the end face extending along the plane orthogonal to the longitudinal axis of the arm is directly connected to the curved surface, and wherein a circular hole is formed substantially in a center of the stopper core portion, the circular hole penetrates through the stopper core portion in a thickness direction thereof, the circular hole is included in a widthwise dimension of the arm core portion extended in a longitudinal direction of the arm core portion, the circular hole is formed in a position which lies between a distal end of the stopper core portion and an intersection of the arm core portion and a widthwise widened portion of the stopper core portion, and the circular hole extends to a proximity of the plane orthogonal to the longitudinal axis of the arm along which the end face of the stopper core portion extends.

2. The check link apparatus according to claim 1, wherein a plane extending along an edge portion of an opening in the holding member through which the arm core portion is inserted in a direction in which a load is applied to the stopper core portion by the holding member intersects the curved surface of the stopper core portion at least when the abutment surface of the holding member is brought into abutment with the stopper portion.

3. The check link apparatus according to claim 1, wherein the arm portion is formed by the arm core portion being covered with the resin material, and at least one set of a recessed portion and a protuberant portion, on which a slider of the holding member is configured to slide, is formed by the covered resin material, and wherein the stopper portion and the abutment surface of the holding member are brought into abutment with each other when the slider of the holding member is positioned on an upwardly inclined surface, which slopes up from the recessed portion to the protuberant portion, or on the protuberant portion.

4. The check link apparatus according to claim 1, wherein a thickness of the resin material that covers the stopper core portion is the thickest at a side of the stopper core portion configured to face the holding member.

5. The check link apparatus according to claim 4, wherein the resin material that covers the stopper core portion has a first thickness lying between the end face of the stopper core portion which is configured to face the abutment surface and a side of the stopper portion configured to face the holding member, wherein the resin material that covers the stopper core portion has a second thickness lying between the curved surface of the stopper core portion and the side of the stopper portion configured to face the holding member, and wherein the second thickness is larger than the first thickness.

6. The check link apparatus according to claim 5, wherein the resin material that covers the stopper core portion has a third thickness at portions other than the end face and the curved surface of the stopper core portion, and wherein the first thickness is larger than the third thickness.

7. The check link apparatus of claim 1, wherein the end face does not have a portion that protrudes from the portion of the end face extending along the plane orthogonal to the longitudinal axis of the arm in a direction of the first end of the arm core portion.

* * * * *